United States Patent [19]

Klajnscek

[11] Patent Number: 4,836,949

[45] Date of Patent: Jun. 6, 1989

[54] LIQUID DETERGENT COMPOSITIONS WITH PHOSPHATE ESTER SOLUBILIZERS

[75] Inventor: Leslie J. Klajnscek, Guelph, Canada

[73] Assignee: Johnson & Johnson Consumer Products, Inc., New Brunswick, N.J.

[21] Appl. No.: 156,385

[22] Filed: Feb. 16, 1988

Related U.S. Application Data

[63] Continuation-in-part of Ser. No. 35,419, Apr. 3, 1987, abandoned.

[51] Int. Cl.[4] ..... C11D 3/04; C11D 7/00; C11D 11/00

[52] U.S. Cl. ..... 252/135; 252/174.16; 252/174.21; 252/174.22; 252/DIG. 1; 252/DIG. 14; 252/DIG. 17

[58] Field of Search ..... 252/135, 174.16, 174.21, 252/DIG. 1, DIG. 17, DIG. 14, 174.22

[56] References Cited

U.S. PATENT DOCUMENTS

| | | | |
|---|---|---|---|
| 2,954,348 | 9/1960 | Schwoeppe | 252/109 |
| 3,156,655 | 10/1964 | Bright | 252/109 |
| 3,951,826 | 4/1976 | Rasmussen | 252/8.9 |
| 4,018,696 | 4/1977 | Hellsten et al. | 252/89 R |
| 4,088,598 | 5/1978 | Williams | 252/135 |
| 4,105,592 | 8/1978 | Collins | 252/545 |
| 4,622,173 | 11/1986 | Broze et al. | 252/528 |
| 4,624,803 | 11/1986 | Balzer et al. | 252/527 |
| 4,661,280 | 4/1987 | Oahadi et al. | 252/99 |

FOREIGN PATENT DOCUMENTS

| | | | |
|---|---|---|---|
| 825649 | 10/1969 | Canada | 252/135 |

*Primary Examiner*—A. Lionel Clingman
*Attorney, Agent, or Firm*—Steven P. Berman

[57] ABSTRACT

This invention relates to liquid detergent compositions particularly suited for use on infant and children's clothing comprising an alkoxylated alcohol or alkoxylated alkyl phenol, a fatty acid or alkyl ether carboxylate, an alkyl phosphate ester or alkoxylate phosphoate ester, a water-soluble builder and water.

9 Claims, No Drawings

LIQUID DETERGENT COMPOSITIONS WITH PHOSPHATE ESTER SOLUBILIZERS

REFERENCE TO RELATED APPLICATIONS

This application is a continuation-in-part of copending application Ser. No. 035,419, filed Apr. 3, 1987, now abandoned.

BACKGROUND OF THE INVENTION

This invention relates to liquid detergent compositions. More specifically, this invention relates to liquid detergent compositions which are particularly suited for use on infant and children's clothing.

Liquid detergent compositions suitable for home laundry use first became available in the late 1950's and early 1960's. Traditionally, the first commercial household cleaning materials were produced in a liquid form for the washing of delicate fabrics, dishes and the hair. When these new materials were directed towards heavy duty washing, e.g. clothing and other fabrics, it was found that formulation constraints led liquid laundry detergents to be inferior in cleaning performance compared with powder or granular form. The key to the performance superiority of granular products was their ability to accommodate high levels of sequesterants (builders) whereas the early liquid products could not contain high levels of both surfactant and builder and still remain as stable one-phase solutions.

Since that time, numerous liquid detergent formulations have been set forth in the literature and many have become commercially available. Most of these formulations are based on anionic-nonionic surfactant mixtures. Many of these mixtures of surfactants are not particularly good cleaning agents and therefore the resulting products are not entirely satisfactory. In particular, they do not provide satisfactory cleaning for infant laundry, e.g. diapers and high cotton content infant wear, over a range of conditions. The fact that these products do not contain builders permits calcium and magnesium ions to inactivate the anionic surfactants in hard water conditions. Furthermore, most liquid detergent formulations are inherently of high viscosity due to their high anionic-nonionic surfactant content and hence require volatile solubilizers such as ethanol or propylene glycol to provide appropriate viscosities and stability to permit consumer use.

An advantage of liquid detergents is that they are far more suitable than granular products for spot-cleaning and hand laundry; being predispersed in water they immediately attack the stain and instantly disperse when further water is added. These products, however, tend to be somewhat irritating for use in hand-laundering, a frequent method for washing certain infant wear. This results from the high surfactant levels and the presence of solvents in these products coupled with the presence of solubilizers.

One commercially available granular product directed to this market is satisfactory in its cotton cleaning capability but, since it is soap-based, it results in the formation of insoluble precipitates of calcium and magnesium thereby depositing on the fabrics what is known as soap "scum" or "curd" which may be irritating to the wearer of such fabrics. Further, such soap-based products provide rather poor cleaning of synthetic fabrics. The formation of soap "curd" is also known to inhibit the flame retardancy of the specially-treated fabrics used in infants' sleepwear.

In summary, there is no commercial product presently available which combines cotton cleaning ability competitive to soap products, as well as acceptable cleaning ability on synthetic fabrics, the absence of residue deposition, the convenience of liquids, substantial mildness to those using these products for hand laundering and an inherently low viscosity.

It is an object of this invention to provide a stable liquid detergent composition which has superior cotton cleaning characteristics and which provides acceptable cleaning of other garment fabrics.

It is a further object of this invention to provide an inherently low viscosity liquid detergent composition which totally disperses in water and does not form insoluble, irritating precipitates and which also does not interfere with the flame retardant properties required for infant sleepwear.

It is still a further object of this invention to provide liquid detergent compositions which provide excellent cleansing of infant diapers and infant clothing, yet in comparison with other liquid detergents, is much milder to the skin.

These and other objects are achieved by the compositions of the present invention as hereinafter described.

SUMMARY OF THE INVENTION

The present invention relates to liquid detergent compositions comprising an ethoxylated alcohol or ethoxylated alkyl phenol nonionic surfactant, a fatty acid or alkyl ether carboxylate surfactant, alkyl phosphate ester or alkoxylate phosphate ester hydrotrope, a water soluble detergency builder/alkalinity buffer and water.

The combination of a nonionic surfactant with the detergency builder/alkaline buffer provides the essential cleaning. This desired cleaning is supported by the fatty acid or alkyl ether carboxylate which not only aids cleaning but helps maintain a moderate foam level in use. This combination provides surprisingly strong cleaning, especially on cotton fabrics. The ability to formulate a product without a strong anionic surfactant also allows the product to be particularly mild; even concentrated solutions of the product have been shown to be non-irritating. Additionally, the phosphate esters are found to be the only suitable stabilizer for this system, and contribute to a small extent to the product's cleaning ability. This class of ingredients is also known to be quite mild compared with other classes of anionic surfactants, hence, with presence of phosphate esters does not detract from the non-irritating nature of the basic cleaning ingredients.

DETAILED DESCRIPTION OF THE INVENTION

The present invention relates to liquid detergent compositions consisting of from about 8.0% to about 25.0% of an alkoxylated alcohol or alkoxylated alkyl phenol nonionic surfactant, from about 0.5% to about 5.0% of a fatty acid or alkyl ether carboxylate surfactant, from about 0.5% to about 5.0% of an alkyl phosphate ester or alkoxylate phosphate ester hydrotrope, from about 5.0% to about 15.0% of water soluble detergency builder with the balance made up of water and other minor ingredients normally found in such compositions.

The alkoxylated alcohols which can be utilized in the present invention are of the formula $$R(OC_2H_4)_m(OC_3H_6)_nOH$$

wherein R is straight or branched chain alkyl containing from about 6 to 18 carbon atoms, preferably about 10 to 14 carbon atoms and most preferably 12 to 13 carbon atoms, m is from about 0 to 10, n is from about 0 to 10, with the total of m+n being preferably about 6 to 10.

The ethoxylated alkyl phenols which are useful in the present invention are of the formula

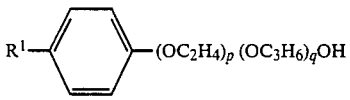

wherein $R^1$ is straight or branched chain alkyl of from about 6 to 14 carbon atoms, preferably 8 to 10 carbon atoms, p is from about 0 to 10, q is from about 0 to 10, and p+q is preferably from about 3 to 10, preferably about 4 to 6.

The alkoxylated alcohols and ethoxylated alkyl phenols are nonionic surfactants which provide cleansing characteristics to the compositions of the present invention. They should be present in an amount of from about 8.0 to 25.0% by weight of the total composition, preferably from about 12 to 20%. If less than about 8.0% by weight of the composition of these nonionics are utilized, the compositions will not exhibit the desired cleansing characteristics and the use of these nonionics at levels greater than about 25% by weight of the total composition is uneconomical, provides little additional cleaning the may lead to stability problems.

The fatty acids which are useful in the compositions of the present invention are of the formula:

$$R^2COOH$$

wherein $R^2$ is straight or branched chain alkyl of from about 6 to 14 carbon atoms, preferably about 10 carbon atoms.

The alkyl ether carboxylates which are useful in the compositions of the present invention are of the formula:

$$R^3(OC_2H_4)_r(OC_3H_6)_sCOOH$$

wherein $R^3$ is a straight or branched chain alkyl of from about 6 to 14 carbon atoms, preferably about 10 carbon atoms, r is from about 0 to 12, s is from about 0 to 12, and r+s is preferably from 1 to 12.

The fatty acid or alkyl ether carboxylate surfactants function primarily as suds controlling agents although they do not provide some cleansing characteristics to the compositions of the present invention, particularly when utilized on cotton fabrics. Since the fatty acid is in solution with alkali metal hydroxides, it is present as the alkali metal salt of the fatty acid and would function as a surfactant in the compositions of the present invention. The fatty acid or alkyl ether carboxylate should be present in an amount of from about 0.5 to 5.0% by weight of the total composition. If less than about 0.5% is utilized, they are not effective as suds controlling agents, and if greater than about 5.0% by weight of the total composition is utilized, there is a possibility of deposition on the fabrics to be cleaned and reduced product phase stability.

The alkoxylate phosphate esters which are useful as hydrotropes in the compositions of the present invention are of the formula:

$$[R^4(OC_2H_4)_t(OC_3H_6)_u]_v OPO_{4-v}H_{3-v}$$

wherein $R^4$ is straight or branched chain, substituted or unsubstituted alkyl of from about 6 to 18 carbon atoms, preferably about 12 carbon atoms, t is from about 0 to 5, u is from about 0 to 5, t plus u is preferably 1 to 5, and v=1 or 2 or mixtures thereof. Furthermore, when t and u are both o, alkyl phosphate esters of the formula $$(R^4)_vOPO_{4-v}H_{3-v}$$

are obtained and are useful as hydrotropes in the compositions of the present invention.

The action of a hydrotrope is somewhat difficult to explain but it can be defined as a material which increases the ability of water to dissolve other materials. In the compositions of the present invention, the hydrotrope unexpectedly maintains the solution in a single phase. In its absence, one would obtain two discrete layers, i.e., the builder in the bottom layer and the other components in the top layer. Hydrotropes normally utilized in liquid detergents, e.g. the sodium and potassium salts of xylene sulfonate, toluene sulfonate and cumene sulfonate, do not result in the formation of stable solutions when utilized in the compositions of the present invention. Likewise, the low molecular weight alcohols, e.g. methanol and ethanol, are not satisfactory in the compositions of the present invention. The phosphate ester hydrotropes are present in the compositions of the present invention from about 0.5 to 5.0% by weight of the total composition. If above about 5% by weight of the total composition is utilized, cleaning negatives can become apparent.

The liquid detergent compositions of the present invention also contain water soluble detergency builders capable of sequestering calcium and magnesium ions from solutions, and providing alkaline buffering for wash solutions. Suitable builders include nitrilotriacetate, sodium or potassium tripolyphosphate, tetrasodium or tetrapotassium pyrophosphosphate, soluble citrate salts, alkoyl taurates, alkoyl isethionates, polymeric acrylates or co-polymer systems containing acrylic components and classes of compounds known as zeolites (sodium aluminosilicates), which act as ion exchange resins. The detergency builders of the present invention are present in from about 5.0 to 12.0% by weight of the total composition. If less than about 5.0% is utilized, the desired cleaning attributes of the compositions will not be achieved and if greater than about 12% is utilized, formulation and stability problems are encountered. The optimal level will vary dependent upon the builder chosen.

The compositions of this invention also contain from about 55 to 85% by weight of the total composition water, preferably from about 65 to 75%.

The compositions of the present invention may also contain additional ingredients generally found in liquid detergent compositions, at their conventional art established levels, provided that these ingredients are compatible with the components required herein. These optional ingredients include softeners, optical brighteners, soil suspension agents, germicides, pH adjusting agents, viscosity modifiers, perfumes, dyes, solvents, carriers and the like.

In the compositions of the present invention, the ratio of the nonionic surfactant to the builder should be from about 3:1 to 1:1, preferably about 2:1 and the ratio of the builder to the hydrotrope should be from about 2:1 to 5:1. The ratio required to maintain stability will vary depending upon the choice of phosphate ester and builder level. The pH of the compositions of the present invention is dependent on the specific components selected and is selected to maintain the desired stability. The compositions can be prepared following normal mixing procedures, but it is desirable that the solutions be alkaline before adding the builder to insure solubility.

The following examples will illustrate in detail the manner in which the present invention may be practiced. It will be understood, however, that the invention is not confined to the specific limitations set forth in the individual examples but rather to the scope of the appended claims.

EXAMPLE I

A liquid detergent composition is prepared having the following major ingredients:

| | % by weight |
|---|---|
| ethoxylated (7) lauryl alcohol | 14.00 |
| tetrapotassium pyrophosphate | 8.00 |
| caprylic-capric ethoxy (5) phosphate ester | 4.00 |
| decanoic acid (95%) | 2.60 |
| ethoxylated (2) stearyl amine | 1.10 |
| fragrance | 0.40 |
| dye | 0.01 |
| preservative | 0.05 |
| optical brightener | 0.30 |
| water | q.s. to 100 |

The above composition is prepared in the following manner. The ethoxylated lauryl alcohol is warmed to about 60° C. in a suitable mixing vessel and to this is added the decanoic acid and the ethoxylated stearyl amine. The latter two ingredients, solids at room temperature (20°–25° C.), are premelted at about 60° C. prior to addition. By warming the alcohol to about 60° C., these ingredients are easily miscible.

In a separate vessel, 95% of the required water, a powdered optical brightening agent and sodium hydroxide are mixed. The amount of sodium hydroxide is precalculated based on the desired finished product pH, and the solution is kept at about 30° C. The alkyl phosphate ester is then added to the solution and mixed until fully dissolved. The preparation consisting of the ethoxylated lauryl alcohol, decanoic acid and ethoxylated stearyl amine is then added to the above solution.

Again, in a separate vessel a solution is premixed using a granular form of tetrapotassium pyrophosphate to a concentration of 50% (w/w). This is then added to the vessel containing the other above-described materials. Fragrance, dye and preservative are then added along with the remaining water to form the above composition.

A test to determine the cleaning ability of a detergent composition can be carried out according to the following procedure:

1. Fabrics and Soils:

Fabrics printed by Test Fabrics, Inc. are soiled with a standard material. The soil is dark grey in color and is intentionally difficult to remove with the washed swatches remaining measurably grey. In practice, no more than about 60%–75% of the soil is removed. Swatches 10 cm×22 cm are cut from the soiled area of the fabric for use in testing.

2. Whiteness Measurement:

Diffuse reflectance of the soiled fabrics is measured using a Hunterlab Color Difference Meter, Model D25. The reflectance of the soiled test cloth is measured before and after washing to give a measure of detergency efficiency. Reflective measurement of unsoiled cloths included in the washload give a measure of the ability of the detergent to retain the soil in suspension. (For this purpose, 10 cm×20 cm swatches of 100% cotton white flannelette diaper are used to represent an "infant"-type fabric.) All fabric swatches are labeled with a waterproof felt marker prior to measurement, not only to identify them according to which product they are being tested with, but also as a guide to orientation when reflectance is remeasured after treatment.

3. Washing:

The apparatus used for the actual washing is a Terg-O-Tometer laboratory-scaled washing machine from the United States Testing Company. The Terg-O-Tometer is a small scale, multiple unit washing machine that simulates the action of the agitator-type home washer. The four breakers can be used to compare four detergents simultaneously or for pair test (using two beakers for each detergent).

The operation of the Terg-O-Tometer for a detergency test is carried out in the following manner:

(a) Operation of the Terg-O-Tometer is at a fixed speed of 100 rpm.

(b) Solutions of the test products are prepared in 1000 ml of water at the desired concentrations, temperature and water hardness.

(c) The heating bath of the Terg-O-Tometer is filled with water, the heaters are turned on and the thermostat is adjusted to hold the bath at the required temperature.

(d) Solutions of the desired water hardness and detergent concentrations are prepared.

(e) With the stainless steel beakers in position in the water bath and the agitators connected, one liter of a test solution is poured into the beakers. The Terg-O-Tometer is operated for a minute or two to equilize the detergent solution temperature with that of the bath. Swatches of soiled and unsoiled fabrics of known reflectance are then placed in the beakers. (In hot or warm water the swatches will become wetted and sink beneath the surface almost as soon as the agitators are switched on. In cooler water, it is sometimes necessary to manually push them into the water to give each detergent equal cleaning time.) The agitation is continued for 15 minutes.

(f) Upon completion of the wash cycle, the machine is turned off and the agitators are removed and rinsed. The solution is decanted from the beakers and the fabric squeezed out by hand.

(g) The empty beakers are rinsed, the swatches replaced and the beakers put back in the bath. One liter of rinse water, at the proper temperature and hardness, is poured in the beakers and agitation is resumed for 15 minutes. This rinse cycle is then repeated.

(h) After the last rinse, the fabric swatches are dried in a convection oven at 90° C. for a minimum of 1½ hours, and the reflectance re-determined.

Three soiled clean swatches are included in each load and the whiteness reflectance of each group of three is averaged. The number of cloth swatches in each load is kept constant to maintain a constant liquid-to-solids ratio.

4. Washing Solutions:

To prepare solutions of the desired temperature, concentration and water hardness, deionized water is first heated on a hot plate in a stainless steel bucket (enough for an entire run of wash plus two rinses) to about 3° C. above the desired washing temperature. The amount of detergent or soap required for 1 liter of solution is measured in a beaker capable of holding a full liter. If soft water washing is intended, pre-heated deionized water is weighed into the beaker containing detergent, to a weight of 1000 g. If hard water is required, the appropriate amount of 3000 ppm standard hardness solution (see below) is measured by graduated cylinder into a 1 liter volumetric flask. This is then made up to 1 liter with pre-heated deionized water, and then added to the beaker containing the detergent or soap. (For rinse water, the detergent is omitted.)

The amount of detergent required for a 1 liter load is calculated from the manufacturer's recommendations for commercial products.

5. Water Hardness: Standard Solution and Titrations

Water hardness solutions are prepared with a calcium to magnesium molar ratio of 3:1.

Water hardness due to calcium ions and magnesium ions is expressed as mg/liter of $CaCO_3$ (ppm) or grains per gallon (gpg) (1 gpg=17.118 ppm). The total of calcium ions and magnesium ions is titrated with standard EDTA using an Eriochrome Black T indicator.

When the composition of Example I is tested against a commercial soap-based granular product and a commercial liquid laundry detergent on cotton and polyester fabrics, the following results are obtained:

COTTON CLEANING EVALUATION

| Water Temperature | Water Hardness ($CaCO_3$ Equivalent) | Change in Whiteness Units Pre-to-Post Treatment: Composition of Example I | Commercial Soap Product | Commercial Liquid Product W |
|---|---|---|---|---|
| 60° C. | 0 ppm | +45.3 | +49.0 | +36.3 |
| | 120 ppm | +33.1 | +33.2 | +25.5 |
| | 260 ppm | +26.0 | +26.1 | +24.8 |
| 40° C. | 0 ppm | +39.7 | +37.9 | +29.1 |
| | 120 ppm | +23.9 | +27.8 | +23.1 |
| | 260 ppm | +22.7 | +23.1 | +20.8 |

These results demonstrate that the compositions of the present invention yield good cleansing results on cotton fabrics comparable to a commercial soap product and superior to a commercial liquid product.

POLYESTER CLEANING EVALUATION (Standard Soiled Dacron R)

| Water Temperature | Water Hardness ($CaCO_3$ Equivalent) | % Change in Whiteness Units Pre-to-Post Treatment: Composition of Example I | Commercial Soap Product | Commercial Liquid Product W |
|---|---|---|---|---|
| 50° C. | 0 ppm | +24 | +20 | 0 |
| | 120 ppm | +14 | −6 | +13 |
| 32° C. | 0 ppm | +16 | +19 | +1 |
| | 120 ppm | +12 | −3 | +12 |

These results demonstrate that the compositions of the present invention result in overall superiority in cleansing when compared to a commercial soap product and a commercial liquid product.

EXAMPLE II

A liquid detergent composition is prepared according to the procedure in Example I and has the following formulation:

| | % by weight |
|---|---|
| ethoxylated (7) lauryl alcohol | 14.00 |
| tetrapotassium pyrophosphate | 7.80 |
| caprylic phosphate (5) ester | 3.00 |
| decanoic acid (95%) | 2.60 |
| ethoxylated (2) stearyl amine | 1.10 |
| fragrance | 0.35 |
| dye | 0.01 |
| preservative | 0.05 |
| optical brightener | 0.30 |
| water | q.s. to 100 |

This formulation is tested against commercially available liquid detergent products, according to the method described in Example I and the following results are obtained:

Standard Soiled Cotton Cleaning Evaluation (Change in Whiteness)

| Conditions | Water Hardness ($CaCO_3$ Equivalent) | Composition of Example II | Commercial Liquid Product X | Commercial Liquid Product Y |
|---|---|---|---|---|
| 60° C. Water | 0 ppm | +34.8 | +18.2 | +29.5 |
| | 55 ppm | +30.4 | +8.9 | +22.2 |
| | 120 ppm | +19.9 | +8.9 | +19.2 |
| | 260 ppm | +15.7 | +6.8 | +16.3 |
| 40° C. Water | 120 ppm | +17.9 | +8.4 | +16.2 |

These results demonstrate that the compositions of the present invention result in overall superiority in cleansing when compared to commercial liquid products.

Standard Soiled Dacron R Polyester Cleaning Evaluations (Change in Whiteness Post Treatment)

| Conditions | Water Hardness ($CaCO_3$ Equivalent) | Composition of Example II | Commercial Liquid Product X | Commercial Liquid Product Y |
|---|---|---|---|---|
| 60° C. Water | 0 ppm | +18.7 | +9.0 | +13.2 |
| | 55 ppm | +14.6 | +7.3 | +13.1 |
| | 120 ppm | +11.5 | +8.2 | +6.6 |
| | 260 ppm | +10.5 | +9.1 | +3.9 |
| 40° C. Water | 120 ppm | +10.3 | +7.7 | +6.0 |

These results demonstrate that the compositions of the present invention result in overall superiority in cleansing when compared to commercial liquid products.

EXAMPLE III

Further cleaning tests are conducted against another commercially available liquid product, which is indicated for use on infant garments. As shown below, this Commercial Liquid Product does not perform as well as the composition of Example II on cotton garment fabrics.

Cotton Cleaning Evaluation - Change in Whiteness

| Conditions | Water Hardness ($CaCO_3$ Equivalent) | Composition of Example I | Commercial Liquid Product Z |
|---|---|---|---|
| 60° C. water | 0 ppm | +41.6 | +24.6 |
| | 120 ppm | +27.3 | +19.6 |
| | 260 ppm | +24.7 | +16.6 |
| 40° C. water | 0 ppm | +41.4 | +23.4 |
| | 120 ppm | +25.2 | +12.5 |
| | 260 ppm | +21.8 | +11.4 |

EXAMPLE IV

The composition of Example II is evaluated for skin mildness by affixing a 2 ml solution of the product on an occlusive patch to the forearm of human volunteers. The composition of Example II, even at 50% (w/w) concentrations, did not elicit a Primary Irritation response. This compares with positive irritation reactions found with as little as 2% of the soap product, 5% of Liquid X and 10% of Liquid W.

EXAMPLES V–XII

Examples V–XII are prepared in accordance with the procedure of Example I, with various alkyl phosphate esters examined. As the following tests show, a number of phosphate esters can be substituted, all providing stable formulations. The stability can be relatively determined by the addition of a destabilizing factor, such as an excess of complex phosphate and comparing the extent to which this excess can be added while still maintaining one phase. In detail, the test involves using 100 ml of a complete formulation containing the phosphate ester to be tested. The beaker and sample are weighed before the test and then TKPP (50% solution) is added drop by drop to the agitated formula. When the formulation becomes cloudy, the beaker is reweighed and the difference taken as a measure of hydrotroping ability is g/100 mL of formulation.

The comparative results are as follows:

| Ex. | Base Alcohol | Moles Ethylene Oxide/mole alcohol | Hydrotroping Ability (g/100 mL 50% tetrapotassium pyrophosphate) |
|---|---|---|---|
| V | Alfol 8/10 ($C_{8-10}$ alcohol) | 5 | 2.7 |
| VI | Alfol 8/10 ($C_{8-10}$ alcohol) | 2.25 | 4.08 |
| VII | lauryl | 0 | 6.74 |
| VIII | Natural $C_{12-14}$ | 2 | 2.56 |
| IX | Neodol 25 ($C_{12-15}$ alcohol) | 3 | 3.26 |
| X | tridecyl alcohol | 3 | 3.0 |
| XI | nonylphenol | 1.5 | 2.44 |
| XII | lauryl | 1.0 | 6.23 |
| — | None added | | —* |

*separates into two phases without any additional tetrapotassium pyrophosphate

EXAMPLE XIII

In accordance with the procedure of Example I, a formulation is prepred containing the following ingredients. The nitrilotriacetate is introduced as a 40% solution.

| | % by weight |
|---|---|
| ethoxylated lauryl (7) alcohol | 14.00 |
| nitrilotriacetate | 7.10 |
| decanoic acid | 2.60 |
| caprylic-capric ethoxy (5) phosphate | 3.00 |
| preservative | 0.10 |
| fragrance | 0.40 |
| dye | 0.01 |
| optical brightener | 0.30 |
| water | q.s. to 100 |

The formulation exhibits cleaning performance and phase stability on par with the formulations disclosed above.

EXAMPLE XIV

In accordance with the procedure of Example I, the following formulation is prepared:

| | % by weight |
|---|---|
| ethoxylated (7) lauryl alcohol | 12.50 |
| tetrapotassium pyrophosphate | 5.00 |
| sodium lauroyl isethionate | 1.20 |
| decanoic acid | 2.00 |
| preservative | 0.10 |
| fragrance | 0.40 |
| dye | 0.01 |
| optical brightener | 0.30 |
| water, minor ingredients | q.s. to 100 |

To this formulation various quaternary and aminic compounds are added to instill static control and a minimum of softness delivery. An example of the efficacy of the tertiary ethoxyamines is shown below by the addition of 1.1% by weight of ethoxy (2) stearylamine.

A coulombetric static evaluation using common sweat socks is conducted in the following manner:

1. Pretreatment:

The purpose of the pretreatment is to remove any extraneous material on the socks.

All the socks are washed with 50 ml of sodium lauryl ether (1) sulphate in a washing machine using a medium size load and hot, soft water. The socks are rinsed three times and allowed to dry naturally at room temperature.

2. Terg-O-Tometer Treatment:

The socks (four per detergent type, with one sock per Terg-O-Tometer beaker) and washed and rinsed twice for 5 minutes each at 100 rpm in hot, soft water. The detergent concentrations are as follows: 1.8 g of powdered laundry granules with a recommended usage of 1¼ cup (300 ml), or the soap based product or 2.0 ml of Example XII per each liter-sized Terg-O-Tometer beaker.

3. Drying:

The socks are spun dry using the spin cycle of the washing machine and then are dried for 45 minutes in the dryer. They are removed from the dryer with a gloved hand.

4. Measurement of Static:

Static was measured using a standard Faraday Cage and an Keithley 601 electrometer. The electrometer settings are as follows:

| | |
|---|---|
| meterswitch | negative |
| range | $10^{-7}$ coulombs |
| multiplier | 1 |

-continued

| | |
|---|---|
| feedback | fast |

Using a gloved hand, the socks are placed in the Faraday Cage one at a time, with each sock being removed before the next addition. A 20 second equilibration period is allowed between each measurement as recommended by the manufacturer. In calculating the average charge per sock, the total charge is divided by the number of socks used. Normally, a total of 4 to 5 replicates are used.

The composition of Example XII is compared with commercial products, a soap-based granule product and a complex liquid product, W. The results demonstrate the efficacy of addition of an ethoxylated tertiary amine to the composition of Example XIV above.

| Product | Average Charge Per Sock ($\times 10^{-7}$) Coulombs |
|---|---|
| Example XIV with 1.1% ethoxylated (2) stearylamine | −0.19 |
| Commercial Liquid Product W | −0.55 |
| Commercial Granule Soap Product | −0.70 |
| Example XII with no additions | −0.84 |

A similar experiment is conducted using the composition of Example II with ethoxylated stearyl amine added with the following results:

| Product | Average Charge Per Sock ($\times 10^{-7}$) Coulombs |
|---|---|
| Example XIV with 1.1% ethoxylated stearylamine | −0.29 |
| Commercial Liquid Product W | −0.63 |
| Commercial Granule Soap Product | −0.89 |
| Example II with no additions | −1.05 |

EXAMPLE XV

The composition of Example XV is prepared according to the procedure of Example I and contains the following ingredients:

| | % by weight |
|---|---|
| nonyl phenol ethoxylate (9) | 10.00 |
| ethoxylated (7) lauryl alcohol | 7.00 |
| decanoic acid | 2.00 |
| sodium tripolyphosphate | 3.50 |
| tetrapotassium pyrophosphate | 3.50 |
| lauryl ethoxy (7) phosphate | 5.00 |
| preservative | 0.10 |
| fragrance | 0.25 |
| dye | 0.01 |
| optical brightener | 0.25 |
| water | q.s. to 100 |

This formulation demonstrates equivalent cleaning to that of the formulation described in Example I.

In addition to the preferred embodiments described herein, other embodiments, arrangements and variations within the scope of the invention and the scope of the appended claims will be apparent to those skilled in the art.

What is claimed is:

1. A liquid detergent composition comprising:

(a) from about 12 to 20% by weight of the total composition of an alkoxylated alcohol or alkoxylated alkyl phenol;

(b) from about 0.5 to 5.0% by weight of the total composition of a fatty acid or alkyl ether carboxylate;

(c) from about 0.5 to 5.0% by weight of the total composition of an alkyl phosphate ester or alkoxylate phosphate ester;

(d) from about 5.0 to 12.0% by weight of the total composition of a water-soluble builder; and (e) from about 55.0 to 85.0% by weight of the total composition of water.

2. The liquid detergent composition of claim 1, wherein the alkoxylated alcohol is of the formula $$R(OC_2H_4)_m(OC_3H_6)_nOH$$

wherein R is straight or branched chain alkyl containing from about 6 to 18 carbon atoms, m is from about 0 to 10, n is from about 0 to 10 and the total of m plus n is about 6 to 10.

3. The liquid detergent composition of claim 1, wherein the ethoxylated alkyl phenol is of the formula

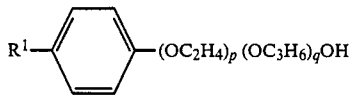

wherein $R_1$ is straight or branched chain alkyl of from about 6 to 14 carbon atoms, p is from about 0 to 10, q is from about 0 to 10, and p plus q is from about 3 to 10.

4. The liquid detergent composition of claim 1, wherein the fatty acid is of the formula $$R^2COOH$$

wherein $R^2$ is straight or branched chain allkyl of from about 6 to 14 carbon atoms.

5. The liquid detergent composition of claim 1, wherein the alkyl ether carboxylate is of the formula $$R^3(OC_2H_4)_r(OC_3H_6)_sCOOH$$

wherein $R^3$ is straight or branched chain alkyl of from about 6 to 14 carbon atoms, r is from about 0 to 12, s is from about 0 to 12, and r plus s is from about 1 to 12.

6. The liquid detergent composition of claim 1, wherein the alkoxylate phosphate ester is of the formula $$[R^4CH_2(OC_2H_4)_t(OC_3H_6)_u]_vOPO_{4-v}H_{3-v}$$

wherein $R^4$ is straight or branched chain, substituted or unsubstituted alkyl of from about 6 to 18 carbon atoms, t is from about 0 to 5, u is from about 0 to 5, t plus u is from about 1 to 5 and v is 1 or 2 or mixtures thereof.

7. The liquid detergent composition of claim 1, wherein the alkyl phosphate ester is of the formula $$(R^4)_vOPO_{4-v}H_{3-v}$$

wherein $R^4$ is straight or branched chain, substituted or unsubstituted alkyl of from about 6 to 18 carbon atoms and v is 1 or 2 or mixtures thereof.

8. The liquid detergent composition of claim 1, wherein the water-soluble builder is selected from the group consisting of nitrilotriacetate, sodium or potassium tripolyphosphate tetrasodium or tetrapotassium pyrophosphate, soluble citrate salts, alkoyl taurates, alkoyl isethionates, polymeric acrylates, co-polymer systems including an acrylate component and zeolites.

9. The liquid detergent composition of claim 1 containing in addition from about 0.5 to 3.0% by weight of an alkoxylated alkylamine.

* * * * *